US009144723B2

(12) United States Patent
Touchette

(10) Patent No.: US 9,144,723 B2
(45) Date of Patent: Sep. 29, 2015

(54) GOLF CLUB

(71) Applicant: Centerline Golf Clubs, Inc., Garden City, ID (US)

(72) Inventor: Shane M. Touchette, Boise, ID (US)

( * ) Notice: Subject to any disclaimer, the term of this patent is extended or adjusted under 35 U.S.C. 154(b) by 39 days.

(21) Appl. No.: 13/935,553

(22) Filed: Jul. 4, 2013

(65) Prior Publication Data

US 2014/0162807 A1 Jun. 12, 2014

Related U.S. Application Data

(60) Provisional application No. 61/668,532, filed on Jul. 6, 2012, provisional application No. 61/733,157, filed on Dec. 4, 2012.

(51) Int. Cl.
*A63B 53/02* (2015.01)
*A63B 53/04* (2015.01)

(52) U.S. Cl.
CPC ..... *A63B 53/0466* (2013.01); *A63B 53/02* (2013.01); *A63B 2053/0408* (2013.01); *A63B 2053/0454* (2013.01)

(58) Field of Classification Search
CPC ..... A63B 53/02; A63B 2053/0408; A63B 2053/0454; A63B 53/0466
USPC ..... 473/345, 346, 314
See application file for complete search history.

(56) References Cited

U.S. PATENT DOCUMENTS

| | | | | |
|---|---|---|---|---|
| 4,313,607 | A | 2/1982 | Thompson | |
| 4,725,062 | A * | 2/1988 | Kinney, III | 473/330 |
| 5,180,166 | A | 1/1993 | Schmidt | |
| 5,199,707 | A | 4/1993 | Knox | |
| 5,908,356 | A * | 6/1999 | Nagamoto | 473/224 |
| 5,941,782 | A * | 8/1999 | Cook | 473/346 |
| 6,623,375 | B2 | 9/2003 | Davies | |
| 6,974,393 | B2 * | 12/2005 | Caldwell et al. | 473/324 |
| 7,022,029 | B2 * | 4/2006 | Caldwell | 473/324 |
| 2004/0033846 | A1 * | 2/2004 | Caldwell | 473/345 |
| 2007/0004532 | A1 * | 1/2007 | Lee et al. | 473/336 |
| 2011/0014992 | A1 * | 1/2011 | Morrissey | 473/314 |
| 2011/0294592 | A1 * | 12/2011 | Guerriero | 473/314 |
| 2012/0172140 | A1 * | 7/2012 | Guerriero | 473/242 |

FOREIGN PATENT DOCUMENTS

| | | |
|---|---|---|
| GB | 2303796 | 5/1997 |
| WO | WO/98/29051 | 7/1998 |

* cited by examiner

*Primary Examiner* — Stephen Blau
(74) *Attorney, Agent, or Firm* — Adrian D. Battison; Ade & Company Inc

(57) ABSTRACT

A golf club has a club head forming a generally hollow body having a generally planar front wall for impacting a ball, a rear wall opposite to the front wall, two side walls, a top wall and a bottom wall surrounding a hollow interior. A tubular shaft hosel extends upwardly from the top wall of the club head and an upstanding center wall is located between the side walls and extending rearwardly from the front wall so as to transfer forces between walls. A portion of the hosel is connected to the top wall and the center wall so as to transfer forces therebetween. The front edge of the center wall can be recessed away from the front wall to allow some flexing of the front wall on impact.

23 Claims, 4 Drawing Sheets

GOLF CLUB

CROSS-REFERENCE TO RELATED APPLICATIONS

This application claims the benefit under 35 USC 119(e) of U.S. Provisional Application Ser. No. 61/668,532 filed Jul. 6, 2012 and of U.S. Provisional Application Ser. No. 61/733,157 filed Dec. 4, 2012, the contents of which are incorporated herein by reference.

FIELD OF THE INVENTION

This invention relates to an improved golf club.

BACKGROUND OF THE INVENTION

The present invention relates to golf clubs of the wood or hybrid type where the club is formed as a hollow body including front, rear, top, bottom and side walls surrounding a hollow interior.

For clarity it is pointed out that a wood is a type of club which have longer shafts and larger, rounder heads than other club types, and are used to hit the ball longer distances than other types.

Woods are so called because, traditionally, they had a club head that was made from hardwood, generally persimmon, but modern clubs have heads made from metal, for example titanium, or composite materials, such as carbon fiber. The change to stronger materials has allowed the design of the modern woods to incorporate significantly larger heads than in the past. Woods are numbered in ascending order starting with the driver, or 1-wood, which has the lowest loft, usually between 9 and 13 degrees, and continuing with progressively higher lofts and numbers.

Woods generally fall into two classes, drivers and fairway woods, with a traditional set of clubs including a driver and one or two fairway woods (usually numbered 3 and 5.

A hybrid is a type of club used in the sport of golf with a design which differs from that of irons and woods. The name "hybrid" has been generalized, combining the familiar mechanics of an iron with the more forgiving nature and better distance of a wood. The long shaft of a fairway wood also requires lots of room to swing, making it unsuitable for tighter lies such as "punching" out from underneath trees. In addition, the fairway wood clubface is designed to skim over instead of cutting into turf, which makes it undesirable for shots from the rough. The answer to this dilemma for many players is to replace the 1-4 irons with hybrids A hybrid generally features a head very similar to a fairway wood; hollow steel or titanium with a shallow, slightly convex face. A hybrid head is usually marginally shallower and does not extend backwards from the face as far as a comparable fairway wood; the head must have an iron-like lie angle and therefore has a flatter sole than a fairway wood.

In U.S. Pat. No. 6,623,375 (Davies) issued Sep. 23, 2003 is disclosed a golf club where the axis of the hosel passes through a line extending rearward from the center of the front face. That is the golf club iron has a club head having a generally planar generally rectangular front face for impacting a ball with a horizontal top edge and a horizontal bottom edge. The front face is symmetrical about an imaginary upright center line at right angles to a transverse line and equidistant between the sides so that the upright center line and the transverse center line intersect at an imaginary center point of the front face. The club head defines an imaginary horizontal center line at right angles to the transverse line passing through the imaginary center point of the front face and substantially through the center of gravity of the head. A tubular shaft hosel is integrally attached to the rear face of the club head with an axis of the tubular hosel at the club head coaxial with the axis of the shaft. The hosel is arranged so that the axis of the shaft and the hosel intersects the imaginary horizontal center line at a position reward of the center of gravity. This has been shown to reduce golf club twist at impact.

Similar arrangements are shown in the following:

USP 2011/0014992 (Morrissey) published Jan. 20, 2011;

PCT WO 98/29051 (Dalton) published Jul. 2, 1998;

GB 2 303 796 (Paxton) published May 3, 1997;

Another area where improvement in the operation of golf clubs can be made is in the structure and stability of the golf club head.

U.S. Pat. No. 4,313,607 (THOMPSON) issued Feb. 2, 1982 shows a reinforcing pin extending between the front face and the back wall to reinforce the front face.

U.S. Pat. No. 5,180,166 (Schmidt) issued Jan. 19, 1993 shows what they call a "dentritic" (this is apparently a word meaning tree like) structure which has a series of walls extending rearwardly from the front face.

U.S. Pat. No. 5,941,782 (Cook) issued Aug. 24, 1999 shows a pair of low walls extending rearwardly from the front face.

SUMMARY OF THE INVENTION

It is one object of the present invention to provide an improved golf club of this general type.

According to a first aspect of the invention there is provided a golf club comprising:

a club head forming a generally hollow body having a generally planar front wall for impacting a ball, a rear wall opposite to the front wall, two side walls, a top wall and a bottom wall surrounding a hollow interior;

a tubular shaft hosel extending upwardly from the top wall of the club head;

and an upstanding center wall between the side walls and connected to at least some of the top wall, bottom wall, front wall and rear wall;

wherein a portion of the hosel connects to the top wall and to the center wall so as to transfer forces therebetween.

According to a second aspect of the invention there is provided a golf club comprising:

a club head forming a generally hollow body having a generally planar front wall for impacting a ball, a rear wall opposite to the front wall, two side walls, a top wall and a bottom wall surrounding a hollow interior;

a tubular shaft hosel extending upwardly from the top wall of the club head so that a base end of the hosel flares outwardly and merges into the top wall;

a shaft attached to the hosel so that an axis of the tubular hosel at the club head is coaxial with an axis of the shaft;

the hosel being arranged on the club head so that the shaft extends at an angle to a substantially vertical center plane through the front face so that the club is intended to be swung in driving action of a driver or iron to cause impact;

the front wall lying in a plane at an angle to a vertical plane containing a bottom edge of the front face so as to provide a loft angle for driving the ball during impact;

and an upstanding center wall between the side walls and extending to at least some of the top wall, the front wall, the rear wall and the bottom wall so as to divide the hollow interior into two substantially symmetrical halves.

Preferably the front wall is symmetrical about an imaginary upright center line and the center wall is located at the center line.

Preferably the center wall is at right angles to the front wall.

Preferably the club head is shaped such that a center of gravity thereof lies substantially in the plane of the center wall.

Preferably the hosel is arranged on the top wall so that the axis of the shaft and the hosel intersects the center wall substantially at the center of gravity.

Preferably the hosel is arranged on the top wall so that the axis of the shaft and the hosel intersects the center wall at a point at which a line at right angles to the axis intersects the front face substantially at a center thereof.

Preferably the center wall is connected to the top wall, the front wall, the rear wall and the bottom wall so as to divide the hollow interior into two substantially symmetrical halves. However provided it is connected to and supports the front wall along the center line, it is not essential that the wall connect to each of the other walls.

Preferably the angle of the shaft to the transverse line is less than 70 degrees.

Preferably the front face has ball engaging grooves parallel to the transverse line covering substantially the whole of the front face.

Preferably the an intersection between the front face and the bottom wall at a center of the front face has a radius of curvature greater than 0.25 inches so as to present a curved edge at the ground.

Preferably the base of the hosel at the top wall is set back from a top edge of the front face.

Preferably the hosel is set backwards, directly from the clubs face so that it is of the order of ¼ inch from the front face edge and ½ inch to one side from a center line of the front face to allow for ball clearance.

Preferably the center wall intersects and is aligned vertically through the optimum striking position on the face.

Preferably the center wall is substantially the same thickness as the other walls.

Preferably the hosel passes through the top wall and is attached to the center wall.

Preferably the hosel connects to the top wall and the center wall so as to transfer forces therebetween.

Preferably the hosel connects to the top wall and to the center wall by casting to form an integral structure or by welding.

Preferably the center wall includes a front edge which is recessed from at least part of the front wall to allow flexing of the front wall on impact.

Preferably the recessed front edge is concave so as to be spaced from the front wall by a greater distance at a mid-height thereof.

The arrangement herein thus provides a driver or hybrid club with an internal centered or middle wall.

A previous arrangement is shown in U.S. Pat. No. 6,623,375 issued Sep. 23, 2003 by Davies and provides a golf club iron which has a club head having a generally planar generally rectangular front face for impacting a ball with a horizontal top edge and a horizontal bottom edge. The front face is symmetrical about an imaginary upright center line at right angles to a transverse line and equidistant between the sides so that the upright center line and the transverse center line intersect at an imaginary center point of the front face. The club head defines an imaginary horizontal center line at right angles to the transverse line passing through the imaginary center point of the front face and substantially through the center of gravity of the head. A tubular shaft hosel is integrally attached to the rear face of the club head with an axis of the tubular hosel at the club head coaxial with the axis of the shaft. The hosel is arranged so that the axis of the shaft and the hosel intersects the imaginary horizontal center line at a position reward of the center of gravity.

Though the above design is consistently effective on the mechanical testing device, it has proved harder to play for actual test subjects. The "rear" positioning of the hosel on an "iron" causes the bottom leading edge of the club face to cut into the ground easier. This is troublesome for golfers who have not refined their swing. The tendency is to make too large of a divot causing miss hits and potential damage to the golf club.

The new design as described in detail hereinafter utilizes the same hosel angles, but repositions the hosel on the top surface of a driver or hybrid. The hosel has also been moved backwards, directly from the clubs face so that it is of the order of ¼ inch to the front face edge and ½ inch to center line to allow for ball clearance while maintaining the same alignment angle through the club face. The angle on the bottom leading edge of the club face has been reduced to help eliminate the cutting in effect to the ground. That adjustment combined with the larger bottom surface of a hybrid style golf club head made the perfect match.

An issue with hollow club heads is sound resonance caused by impact with the golf ball and power loss on the hit from flex in the clubs face. The new center line mid wall is the same thickness as the clubs outer walls and eliminates all of the issues with the hollow head designs. The inner mid-wall lies in a plane which intersects and is aligned vertically through the optimum striking position on the face. The centered solid mid-wall is attached on all sides to the outer body and face by permanent molding or welding to create the most rigid solid and quiet center line, golf club design. The centered solid mid-wall is however in some embodiments recessed from the front wall to leave a space behind the front wall allowing the front wall to flex under impact.

The arrangement herein can also be applied to a traditionally shaped golf drivers and hybrids to provide the centered inner alloy wall. Preferably however the hosel is repositioned so the hosel angle now aligns through the optimum ball striking position on club face. The hosel is also set back off of club face ¼ inch to edge to allow for ball clearance.

The hosel position eliminates the "hinging" effect caused by the rear (heel) hosel attachment on traditional golf clubs. The hosel position also maximizes kinetic energy generated with the club shaft through the golf ball, resulting in much longer hitting distance.

The centered inner strength wall makes the hollow cavity and face of drivers and hybrids very rigid. The result enhances the power of the repositioned hosel while making the golf clubs very quiet from less vibration in the previously hollow core. The molded inner wall is the same thickness as the outer club wall and is formed of an alloy, generally the same alloy as the peripheral walls, for reduced weight.

The club provides the one or more of following features which are new and novel:

1) in view of the symmetrical location of the axis of the shaft which intersects the horizontal center line, this acts to minimize or eliminate club head twist at high and full swing speeds (60 to 130 mph.) caused by:

a) air friction on down swing b) contact with grass or sand prior to contact with ball c) head snap or twist at ball contact 2) the axis of shaft intersecting the center line which contains or substantially contains the club head center of gravity provides most efficient transfer of energy (like a baseball bat).

3) The club face is balanced in both in weight and surface area about the center line so as to provide a balanced or symmetrical impact surface for both air flow and ball impact.

These three features should give better distance and ball control.

For each degree that the club head is off of perpendicular to the ball on contact, the ball travels approximately 0.628" off course per yard of travel i.e. a 100 yard shot would be approximately 20 yards off track, or causes a slice or hook by spinning the ball.

Heal and toe shots are common terms used if the ball does not hit the sweet spot. With this club design there is a maximized sweet spot because the club is nearly 100% balanced. This is a balanced head design that is not triangular.

These clubs may not conform to PGA rules for club design. Manufacturers have made club heads larger and with perimeter weighting to make golf clubs have a larger "sweet spot" and make them more forgiving.

Designs for a 3 and 7 iron as typical examples can be manufactured where a typical 3 iron has 19 to 20 degrees of loft; and a typical 7 iron has 34 to 36 degrees of loft.

The intention is to provide all standard degrees of loft from a 1 to 9 iron as well as a pitching wedge, sand wedge and a lob wedge, that is, up to 65 degrees.

U.S. Pat. No. 5,855,524 includes data relating to the angles (table 1) for standard lie and loft angles, to which reference is made for further details in this regard.

BRIEF DESCRIPTION OF THE DRAWINGS

One embodiment of the invention will now be described in conjunction with the accompanying drawings in which.

DETAILED DESCRIPTION

Figure 1:
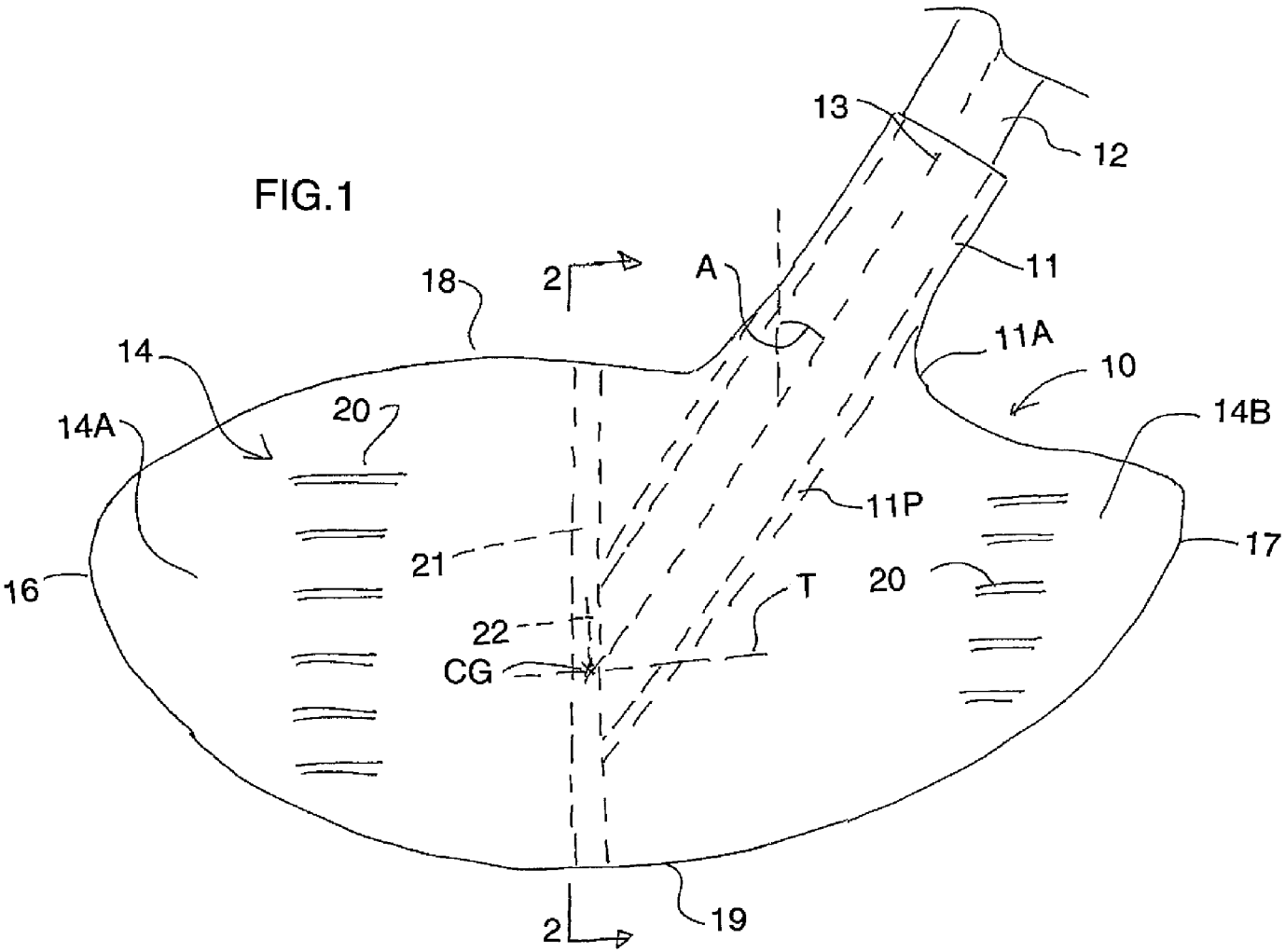
FIG. 1 is a front elevational view of one example of a golf club head according to the present invention showing the various points of interest of the club.
Figure 2:
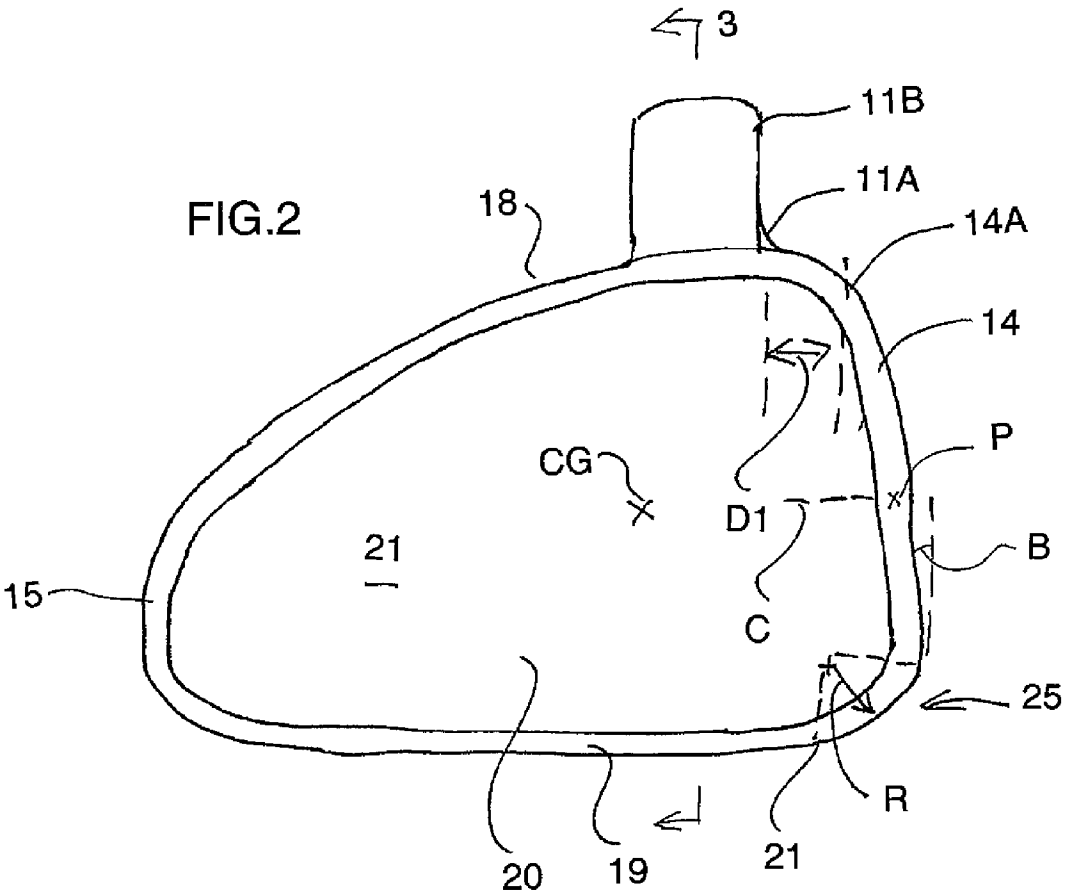
FIG. 2 is a cross-sectional view along the lines 2-2 of the golf club head shown in FIG. 1.

In FIGS. 1 and 2 is shown a golf club having a club head 10, a hosel 11 and a shaft 12. The shaft 12 has a center line 13. The hosel is a tubular body having a center line which is coincident with the center line 13 so that the shaft extends into the hosel and its centre line continues along the center line of the hosel.

The club head 10 forms forming a generally hollow body having a generally planar front wall 14 for impacting a ball, a rear wall 15 opposite to the front wall, two side walls 16, 17, a top wall 18 and a bottom wall 19 surrounding a hollow interior 20.

The hosel is arranged on the club head so that the shaft extends at an angle A less than ninety degrees to a transverse line which angle is arranged so that the club is intended to be swung in driving action of a driver or iron to cause impact. The front wall lies in a plane at an angle B to a vertical plane so as to provide a loft angle for driving the ball during impact.

An upstanding center wall 21 is provided between the side walls and connected at its front edge to the front wall so as to extend rearwardly therefrom. The front wall is symmetrical about an imaginary upright center line 22 and the center wall is located at the center line 22. The center wall 21 is at right angles to the front wall 14 so as to extend directly rearwardly therefrom. The club head is shaped such that a center of gravity CG thereof lies substantially in the plane of the center wall.

The hosel is arranged on the top wall so that the axis of the shaft and the hosel intersects the center wall 21 substantially at the center of gravity CG. The hosel is arranged on the top wall so that the axis of the shaft and the hosel intersects the center wall 21 at a point at which a line C at right angles to the axis intersects the front face substantially at a center thereof. Thus the plane of the center wall intersects and is aligned vertically through the optimum striking position on the face.

Figure 3:
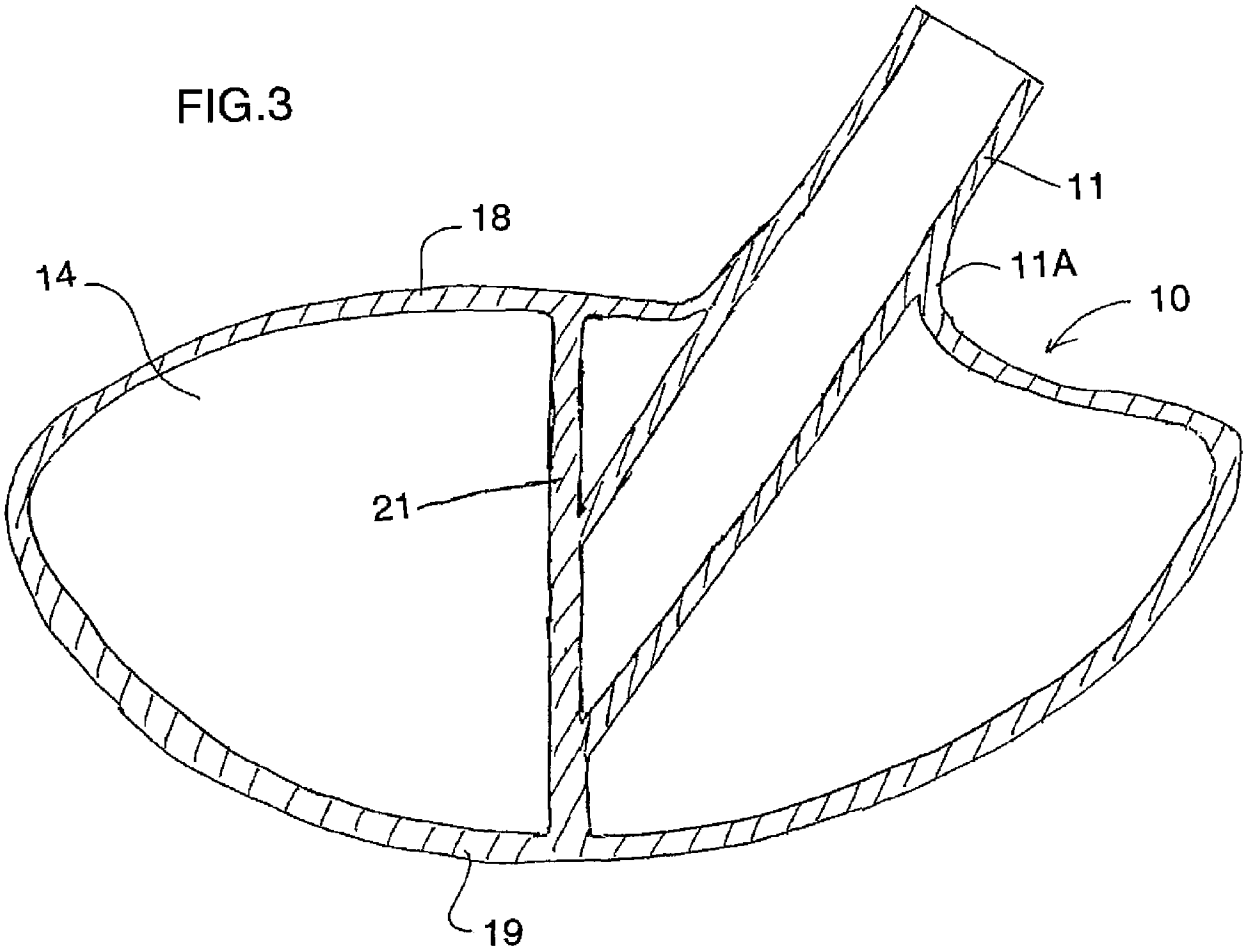
FIG. 3 is a cross-sectional view along the lines 3-3 of the golf club head shown in FIG. 2.

The center wall 21 is connected sufficiently to most or all of to the top wall 18, the front wall 14, the rear wall 15 and the bottom wall 19 so as to divide the hollow interior into two substantially symmetrical halves as shown in FIG. 3. The center wall by is connections to the inside surfaces of most of the walls thus provides structural stability for the club head. The center wall 21 is substantially the same thickness as the other walls, which is of the order of 1.0 to 5.00 mm and preferably of the order of 2.5 to 3.0 mm.

The front face 14 has ball engaging grooves 20 parallel to the transverse line covering substantially the whole of the front face.

In order to reduce the tendency of the club to cut into the ground, the intersection 25 between the front wall 14 and the bottom wall 19 at a center of the front face has a radius of curvature R greater than 0.25 inches so as to present a curved edge at the ground.

The base of the hosel 11 at the top wall 18 merges into the top wall with a smoothly curved flared section 11A so that a front face 11B of the hosel is set back from a top edge 14A of the front face 14. Thus the hosel is set backwards, directly from the clubs face so that it is a distance D1 of the order of ¼ inch from the front face edge and a distance D2 ½ inch to one side from a center line of the front face to allow for ball clearance.

As shown in FIG. 3 the hosel also passes through the top wall and includes a portion 11P underneath the top wall which extends to the center of the hollow body and is attached to the center wall 21. The portion 11P of the hosel which connects to the top wall 18 and the center wall 21 acts to transfer forces therebetween.

Typically an arrangement of this type is formed by casting the structure in sections and then by welding the sections together to form the enclosed hollow body. In this arrangement, the hosel can be connected to the top wall and to the center wall by casting to form an integral structure or by welding. The selection of the components to be formed together in the casting process and then welded together is a design matter well known to a person skilled in this art. However the connection of the hosel both to the top wall and the center wall imparts strength to the structure to apply rigidity to the club head and the hosel which prevents pinging and ensures maximum communication of force from the shaft to the ball through the front face.

The center line 13 of the shaft is arranged by the position of the hosel relative to the rear face 15 so that it intersects with the center line C at a position rearward of the center of gravity CG as shown in FIG. 1.

Thus the front face 14 defines an outer portion 14A and an inner portion 14B where the outer portion 14A is outward of the center of gravity and the inner portion 14B is inward of the center of gravity. These portions are substantially symmetrical so that they have a similar distance from the center of gravity CG to the side edge 16 and 17.

Thus the line C intersects the front face at a center point P thereof which is formed by the imaginary intersection between the imaginary center line L and the imaginary transverse line T. The center point P lies on the same center line C as the center of gravity approximately although the center of gravity may be slightly below this line depending upon the weight of the hosel relative to the club head and with width of the club head at the bottom surface. However the club is designed so that the center of gravity, the line C and the point P are substantially coincident since this provides the advantageous symmetrical location of both the center of gravity and the center of the front face relative to the axis of the shaft.

The front face 14 includes ball engaging grooves 20 over the full face so they extend from the top edge 21 of the front face to the bottom edge 22 of the front face. The grooves also extend between the side edges 16 and 17. Thus the whole of the front face can act as an impact surface and there is little difference in effect whether the ball is impacted on the center line C or outwardly or inwardly of the center line.

The hosel 11 is arranged relative to a vertical plane of the club head so that is defines an angle A relative to the vertical. The angle A is greater than 20 degrees and this angle is selected so that it provides the same angle as would be used in a conventional iron or driver so that the user can effect a conventional stroke which will move the head at a speed of the order of 60 to 120 miles per hour in a driving action. Thus the present club is not intended as a putter but is intended to replace the conventional iron or driver with the significant forces involved in the driving action.

The arrangement of the symmetrical face allows the face to provide a very large impact area which can be as large as 3.125 inches wide by 1.75 inches high.

Figure 4:
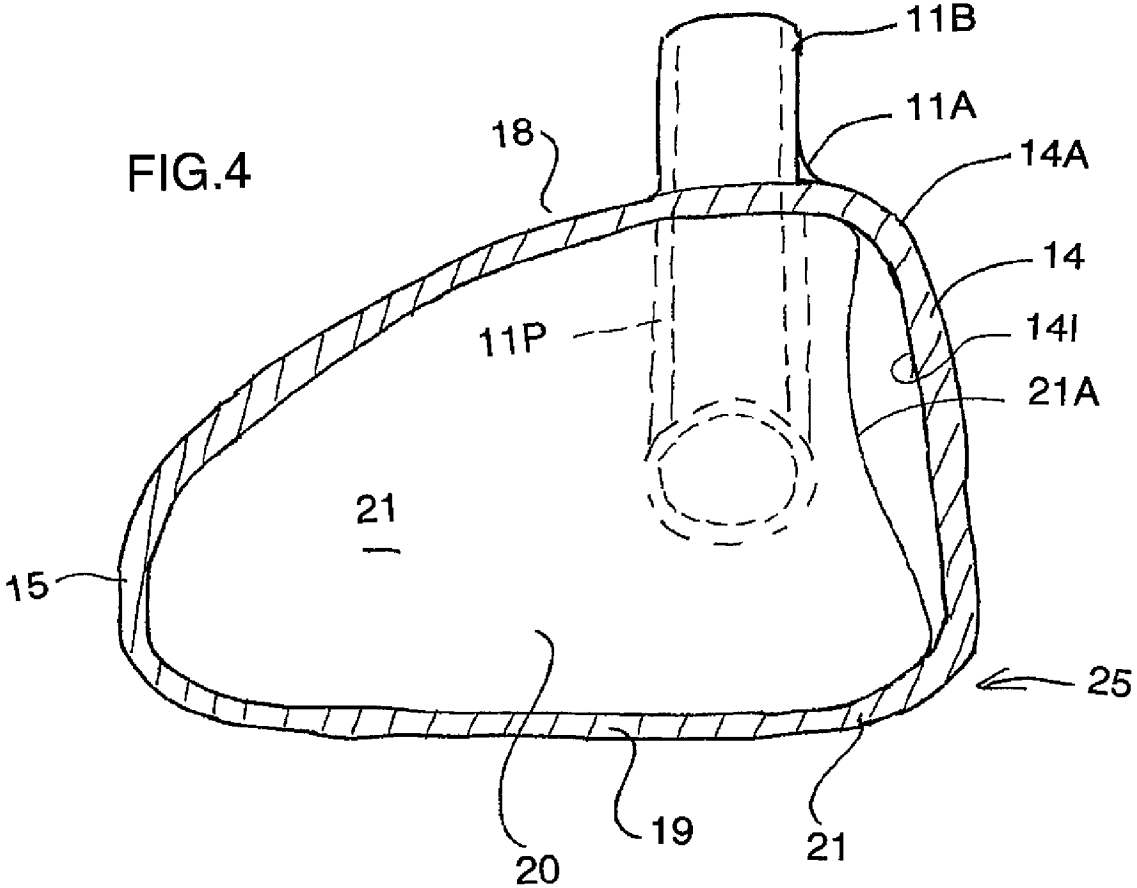
FIG. 4 is a cross-sectional view along the lines 2-2 of the golf club head showing a modified embodiment.

In FIG. 2, a front edge of the center wall 21 is directly in contact with the inside surface of the front wall 14 and may be attached thereto. In an alternative arrangement shown in FIG. 4, the front edge 21A is recessed from an inside surface 14I of at least part of the front wall 14 to allow flexing of the front wall on impact. As shown the recessed front edge 21A is concave so as to be spaced from the front wall 14I by a greater distance at a mid-height thereof than at the top and bottom thereof. The front edge 21A may merge into the front face 14 and be attached thereto at the intersection with the top and bottom walls so as to provide stability to the front face while allowing the center of the front face to flex rearwardly on impact.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

The invention claimed is:

1. A golf club comprising:

a club head forming a generally hollow body having a generally planar front wall for impacting a ball, a rear wall opposite to the front wall, two side walls, a top wall and a bottom wall surrounding a hollow interior;

a tubular shaft hosel extending upwardly from the top wall of the club head;

and an upstanding center wall between the side walls and connected to at least some of the top wall, bottom wall, front wall and rear wall;

wherein a portion of the hosel connects to the top wall and to the center wall so as to transfer forces therebetween.

2. The golf club according to claim 1 wherein the front wall is substantially symmetrical about an imaginary upright center line and the center wall is located in a plane intersecting at the center line.

3. The golf club according to claim 1 wherein the center wall is at right angles to the front wall.

4. The golf club according to claim 1 wherein the club head is shaped such that a center of gravity thereof lies substantially in the plane of the center wall.

5. The golf club according to claim 1 wherein the hosel is arranged so that the axis of the shaft and the hosel intersects the center wall substantially at the center of gravity.

6. The golf club according to claim 1 wherein the hosel is arranged so that the axis of the shaft and the hosel intersects the center wall on a line extending rearwardly from a center of the front wall.

7. The golf club according to claim 1 wherein the hosel is arranged so that the axis of the shaft and the hosel intersects the center wall at a point at which a line at right angles to the axis intersects the front face substantially at a center thereof.

8. The golf club according to claim 1 wherein the center wall is connected at least to the top wall and the bottom wall so as to transfer loads therebetween.

9. The golf club according to claim 1 wherein the an intersection between the front face and the bottom wall at a center of the front face has a radius of curvature greater than 0.25 inches so as to present a curved edge at the ground.

10. The golf club according to claim 1 wherein the hosel at the top wall is set back from a top edge of the front face.

11. The golf club according to claim 10 wherein the hosel at the top wall is set ½ inch to one side from a center line of the front face.

12. The golf club according to claim 1 wherein the center wall is substantially the same thickness as the top, bottom, front and side walls.

13. The golf club according to claim 1 wherein the portion of the hosel is connected to the center wall by welding.

14. The golf club according to claim 1 wherein the center wall includes a front edge which is recessed from at least a center part of the front wall to allow flexing of the front wall on impact.

15. The golf club according to claim 14 wherein the recessed front edge is concave so as to be spaced from the front wall by a greater distance at a mid-height thereof.

16. A golf club comprising:

a club head forming a generally hollow body having a generally planar front wall for impacting a ball, a rear wall opposite to the front wall, two side walls, a top wall and a bottom wall surrounding a hollow interior;

a tubular shaft hosel extending upwardly from the top wall of the club head;

the hosel being arranged on the club head so that an axis of the hosel extends at an angle to a substantially vertical center plane through the front face so that the club is intended to be swung in driving action of a driver or iron to cause impact;

the front wall lying in a plane at an angle to a vertical plane containing a bottom edge of the front face so as to provide a loft angle for driving the ball during impact;

and an upstanding center wall between the side walls and extending to at least some of the top wall, the front wall, the rear wall and the bottom wall so as to divide the hollow interior into two substantially symmetrical halves;

wherein the center wall includes a front edge which is recessed from at least part of the front wall to allow flexing of the front wall;

and wherein the recessed front edge is concave to as to be spaced from the front wall by a greater distance at a mid-height thereof.

17. The golf club according to claim 16 wherein the front wall is substantially symmetrical about an imaginary upright center line and the center wall is located at the center line.

18. The golf club according to claim 16 wherein the center wall is at right angles to the front wall.

19. The golf club according to claim 16 wherein the center wall is substantially the same thickness as the front wall, rear wall, two side walls, top wall and bottom wall.

20. A golf club comprising:

a club head forming a generally hollow body having a generally planar front wall for impacting a ball, a rear wall opposite to the front wall, two side walls, a top wall and a bottom wall surrounding a hollow interior;

a tubular shaft hosel extending upwardly from the top wall of the club head;

the hosel being arranged on the club head so that a longitudinal axis of the hosel extends at an angle to a substantially vertical center plane through the front face so that the club is intended to be swung in driving action of a driver or iron to cause impact;

the front wall lying in a plane at an angle to a vertical plane containing a bottom edge of the front face so as to provide a loft angle for driving the ball during impact;

and an upstanding center wall between the side walls;

the center wall being connected to the top wall, the rear wall and the bottom wall;

wherein the center wall includes a front edge which is recessed from at least a center part of the front wall to allow flexing of the front wall.

21. The golf club according to claim 20 wherein the front wall is substantially symmetrical about an imaginary upright center line and the center wall is located at the center line.

22. The golf club according to claim 20 wherein the center wall is at right angles to the front wall.

23. The golf club according to claim 20 wherein the center wall is substantially the same thickness as the front wall, rear wall, two side walls, top wall and bottom wall.

* * * * *